US010683742B2

(12) United States Patent
Elmer

(10) Patent No.: US 10,683,742 B2
(45) Date of Patent: Jun. 16, 2020

(54) LIQUID PISTON COMPRESSOR SYSTEM

(71) Applicant: Encline Artificial Lift Technologies LLC, Houston, TX (US)

(72) Inventor: William G. Elmer, Tyler, TX (US)

(73) Assignee: Encline Artificial Lift Technologies LLC, Houston, TX (US)

( * ) Notice: Subject to any disclaimer, the term of this patent is extended or adjusted under 35 U.S.C. 154(b) by 314 days.

(21) Appl. No.: 15/730,264

(22) Filed: Oct. 11, 2017

(65) Prior Publication Data

US 2018/0100385 A1 Apr. 12, 2018

Related U.S. Application Data

(60) Provisional application No. 62/406,759, filed on Oct. 11, 2016.

(51) Int. Cl.
*F04B 49/04* (2006.01)
*E21B 43/40* (2006.01)
*E21B 43/16* (2006.01)

(52) U.S. Cl.
CPC ..... *E21B 43/40* (2013.01); *E21B 43/168* (2013.01)

(58) Field of Classification Search
CPC .... F04B 49/04; F04B 39/0011; F04B 27/005; F04B 9/1176
USPC ..... 417/103
See application file for complete search history.

(56) References Cited

U.S. PATENT DOCUMENTS 4,074,954 A 2/1978 Roberts
4,341,629 A * 7/1982 Uhlinger ..... B01D 61/022 210/128
5,771,693 A 6/1998 Coney
6,009,945 A * 1/2000 Ricks ..... E21B 34/06 166/151
6,158,508 A * 12/2000 Lemetayer ..... E21B 43/122 166/250.15
RE37,603 E 3/2002 Coney
(Continued)

OTHER PUBLICATIONS

James D. Van De Ven; Perry Y. Li, "Liquid Piston Gas Compression," Elsevier, 2009, 9 pages, www.elsevier.com/ocate/apenergy.
(Continued)

*Primary Examiner* — Kipp C Wallace
(74) *Attorney, Agent, or Firm* — Peter L. Brewer; Thrive IP

(57) ABSTRACT

A gas emissions recovery system. The recovery system is designed to receive fugitive gas emissions from a compressor, and pressurize those emissions using a double-acting liquid piston compressor system. The pressurized fugitive gas emissions may be returned to the compressor, or may be injected into a wellbore. The system includes a first liquid piston chamber and a second liquid piston chamber. Each chamber holds an incompressible fluid that is used to force a gas into a fluid reservoir in response to a piston motion of the incompressible fluid. A pump is provided, with the pump being configured to pump the incompressible fluid between the first and second liquid piston chambers and, thereby, induce piston action of the incompressible fluid in the liquid piston chambers. The system includes a processor that controls the cycling of the incompressible fluid in response to signals indicative of liquid levels in the chambers. A method for reclaiming fugitive gas emissions from a compressor is also provided.

22 Claims, 4 Drawing Sheets

(56) References Cited

U.S. PATENT DOCUMENTS

| | | | | |
|---|---|---|---|---|
| 7,093,661 | B2 * | 8/2006 | Olsen | E21B 37/00 166/357 |
| 7,488,159 | B2 | 2/2009 | Bhatt et al. | |
| 7,686,086 | B2 * | 3/2010 | Brammer | E21B 43/40 166/357 |
| 8,037,677 | B2 * | 10/2011 | Fong | H02J 15/006 60/408 |
| 8,297,237 | B2 | 10/2012 | Barth et al. | |
| 8,667,788 | B2 | 3/2014 | Kenway et al. | |
| 9,541,236 | B2 | 1/2017 | Kuehl et al. | |
| 9,611,868 | B2 | 4/2017 | Kenway et al. | |
| 2003/0039554 | A1 * | 2/2003 | Krasnov | F04F 1/06 417/103 |
| 2010/0034671 | A1 * | 2/2010 | Adler | F04F 1/06 417/102 |
| 2013/0104596 | A1 * | 5/2013 | Al-Azzawi | E21B 43/243 62/606 |
| 2013/0315818 | A1 * | 11/2013 | Roy | F04B 39/0011 423/658.3 |
| 2016/0153447 | A1 * | 6/2016 | Yuan | F17C 5/007 417/54 |
| 2016/0160852 | A1 * | 6/2016 | Xiao | F04B 19/06 417/54 |
| 2016/0305413 | A1 * | 10/2016 | Hummelt | F04B 37/18 |

OTHER PUBLICATIONS

"Summary of Requirements for Processes and Equipment at Natural Gas Well Sites," EPA's Air Rules for the Oil & Natural Gas Industry, 3 pages.

"Summary of Requirements for Equipment at Natural Gas Transmission Compressor Stations," EPA's Air Rules for the Oil & Natural Gas Industry, 3 pages.

Taylor Hydraulic Air Compressing Co. Limited, "Illustrated Description of the Taylor Hydraulic Air Compressor and Transmission of Power by Compressed Air", 24 pages.

CIPO Office Action; Canadian Application No. 2,982,024, Encline Artificial Lift Technologies LLC, "Improved Liquid Piston Compressor System," Jan. 15, 2020, 3 pages.

* cited by examiner

LIQUID PISTON COMPRESSOR SYSTEM

CROSS REFERENCE TO RELATED APPLICATIONS

This application claims the benefit of U.S. Ser. No. 62/406,759 entitled "Improved Liquid Piston Compressor System." That application was filed on Oct. 11, 2016, and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of gas compressors. More specifically, the invention relates to a system for the recovery and re-compression of vapors that escape from gas compressors, such as gas sales compressors or compressors used to inject light hydrocarbons into a wellbore annulus during gas lift operations. The invention further relates to a controlled compressor having dual fluid chambers capable of compressing light hydrocarbons that escape from a compressor, to higher pressures, using a piston motion.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing. After the wellbore is completed, a wellhead is placed at the surface to control downhole pressures and to capture production fluids.

Some wellbores are completed primarily for the production of gas (or compressible hydrocarbon fluids), as opposed to oil. Other wellbores initially produce hydrocarbon fluids, but over time transition to the production of gases. In either of such wellbores, the formation will frequently produce fluids in both gas and liquid phases. Liquids may include water, oil and condensate. At the beginning of production, the formation pressure is typically capable of driving the liquids with the gas up the wellbore and to the surface. Liquid fluids will travel up to the surface with the gas primarily in the form of entrained droplets.

During the life of the well, the natural reservoir pressure will decrease as fluids are removed from the formation. As the natural downhole pressure of the well decreases, the gas velocity moving up the well drops below a so-called critical flow velocity. See G. Luan and S. He, *A New Model for the Accurate Prediction of Liquid Loading in Low-Pressure Gas Wells*, Journal of Canadian Petroleum Technology, p. 493 (November 2012) for a recent discussion of mathematical models used for determining a critical gas velocity in a wellbore. In addition, the hydrostatic head of fluids in the wellbore will work against the formation pressure and block the flow of in situ gas into the wellbore. The result is that formation pressure is no longer able, on its own, to produce fluids from the well in commercially viable quantities.

In response, various remedial measures have been taken by operators. For example, operators have sought to monitor tubing pressure through the use of pressure gauges and orifice plates at the surface. U.S. Pat. No. 5,636,693 entitled "Gas Well Tubing Flow Rate Control," issued in 1997, disclosed the use of an orifice plate and a differential pressure controller at the surface for managing natural wellbore flow up more than one flow conduit. The '693 patent is incorporated herein in its entirety by reference.

Operators have sometimes sought to enhance the production of gas by replacing the original production tubing with a smaller-diameter string. A packer may be placed at the bottom of the new production sting to force the movement of gas to the surface through the smaller orifice. The smaller-diameter string creates a more restricted flow path that results in higher velocity in the wellbore, aiding the flow of hydrocarbons to the surface.

Another technique for artificial lift in both oil and gas wells is the gas lift system. Gas lift refers to a process wherein a gas (typically methane, ethane, propane, nitrogen and related produced gas combinations) is injected (or re-injected) into the wellbore downhole to reduce the density of the fluid column. Injection is done through so-called gas lift valves spaced apart vertically along the production tubing. These gas lift valves reside in the annular area formed between the production tubing and the surrounding casing strings. The injection of gas through the valves and into the production tubing decreases the backpressure against the formation by reducing the density of production fluids in the tubing string.

Gas lift has been popular for lifting oil wells, especially in large fields or offshore facilities, as the power station may be remotely located from the wells. In these instances, large compressor stations may be used to inject gas down a number of wells in a field, simultaneously. Gas lift has become increasingly popular in recent years with the proliferation of horizontally completed wells, as gas lift can extend the life of such wells beyond what mechanical pumping alone can provide.

Some gas lift systems rely upon a local compressor that injects a gas from the surface and down the back side of the wellbore, or "annulus." These compressors receive a portion of the gas produced from the well, and then inject it back down the annulus to reduce fluid density in the production column. Such compressors may be single-acting compressors or double-acting compressors. Both compressors rely upon a piston rod to mechanically move, or "pump," gas under pressure. The piston rod reciprocates in response to movement created by a shaft that rotates within a crank case. Thus, high-rpm rotational movement is converted into a rapidly reciprocating linear movement.

Gas compressors rely upon packing seals residing around the piston rod. The seals prevent the gas under compression from leaking past the piston and into the vented compressor crank case. The packing seals comprise a series of piston rings. These are sometimes referred to together as "rod packing." To improve functionality of the rod packing, the elastomeric piston rings are normally lubricated using a clean oil. Lubrication minimizes wear and improves the annular seal around the piston rods. However, even new rod packing that is properly lubricated will have a small amount of gas that leaks past it.

The oil and gas industry is charged with capturing "fugitive" vapors at large gas transmission compressor stations. The industry is also required to document the required maintenance of the rod packing at large compressor stations. These regulations have not yet been proposed for smaller compressors at local well sites, although estimating the emissions of these vapors is now required and contributes to the calculated emissions profile. Further, it is likely that smaller compressors placed at well sites will soon be subject to capturing vapor emissions.

Small compressors at well sites inevitably experience fugitive gas emissions. This is most commonly due to lubrication failure at the piston rings coupled with normal wear and tear. This is further partially due to the high gas discharge temperatures which contribute to degradation of the rod packing.

Because of the historically low cost of natural gas (meaning that vapor emissions do not materially affect profit margins in the industry) and the relatively high cost of maintaining gas compressors, little attention has been paid to fugitive gas emissions from rod packing. However, future environmental or Railroad Commission regulations will likely require that vapors be captured.

Accordingly, a system is needed to capture rod packing emissions and reintroduce them into the pumping process. Further, a system is needed that controls pumping speed to keep pace with emissions. Further still, a need exists for a method of recovering rod packing emissions at low pressure, and then compressing them using a novel controlled liquid piston compressor system.

BRIEF SUMMARY OF THE INVENTION

An emissions recovery system for a gas compressor is first provided herein. The recovery system is designed to capture compressible fluids that escape past the rod packing of a gas compressor. In one aspect, the emissions recovery system is employed at or near a well site that is undergoing gas lift, with recovered emissions being reintroduced into the input line of the gas compressor during gas lift injection.

The emissions recovery system first includes a gas emissions recovery line. The gas emissions recovery line comes off of the crank case (or other housing portion) of the gas compressor. The recovery line captures so-called "fugitive" gas emissions.

The emissions recovery system next comprises a pair of liquid piston chambers. The chambers represent a first chamber and a second chamber. Each liquid piston chamber defines a generally cylindrical vessel configured to contain an incompressible working fluid. The incompressible fluid is preferably water. Such water may be brine, potable water, mixtures of an aqueous solution and anti-freeze, or other suitable incompressible fluids.

The first liquid piston chamber receives gas through the gas emissions recovery line. A one-way check valve permits the gas to enter the first liquid piston chamber as water (or other incompressible fluid) is pushed out of the first liquid piston chamber. The gas is then expelled through a separate first discharge line and into a reservoir when the first liquid piston chamber receives the incompressible fluid. Thus, the first liquid piston chamber operates based on a "huff and puff" principle wherein the fugitive gas emissions are drawn in at a very low pressure, and then cyclically expelled under a much higher pressure.

The second liquid piston chamber also receives gas through the gas emissions recovery line. A one-way check valve permits the gas to enter the second liquid piston chamber as water (or other incompressible fluid) is pushed out of the second liquid piston chamber. The gas is then expelled through a separate second discharge line and into the reservoir when the second liquid piston chamber receives the incompressible fluid. Thus, the second liquid piston chamber also operates based on a "huff and puff" principle, wherein the fugitive gas emissions are drawn in at a very low pressure, and then cyclically expelled under a much higher pressure.

Each liquid piston chamber also has a fluid release line. Each of the fluid release lines is in fluid communication with a shared pump. The pump alternates, or cycles, between receiving the incompressible working fluid from the first chamber and pumping it to the second chamber, and then pumping the incompressible fluid from the second chamber and back to the first chamber. A switch valve is provided at the pump to determine a direction of fluid movement through the fluid release lines. The switch valve is configured so that as the incompressible fluid is being pushed out of one of the liquid piston chambers, it is entering the other liquid piston chamber, forming a dual "piston" motion.

The piston motion of the liquid piston chambers serves to force natural gas that enters the first liquid chamber to be pumped into the reservoir. Similarly, the piston motion forces gas that enters the second liquid chamber to be pumped into the same reservoir. As the piston motion takes place, pressure builds within the reservoir to whatever level is required to deliver the gas back to the compressor inlet or, alternatively, into some other takeaway sink. As a safety precaution, the reservoir is equipped with a relief valve that releases the gas from the reservoir once pressure exceeds a certain safe level. In one aspect, that level is 125 psig. The result is that a relatively small pump moving a relatively small volume of incompressible working fluid between the liquid piston chambers can generate a considerable amount of gas pressure within the reservoir. This pressure allows the gas released from the reservoir to re-enter the original gas compressor where a vast majority re-enters the wellbore from whence it was produced.

In one aspect, the size of the fluid pump and the volume of incompressible fluid in the two liquid piston chambers may be scaled up. For example, a suction header pressure of 1,000 psig and a discharge pressure of up to 4,000 psig may be provided. This allows the stream of compressed gas to be directed back into the wellbore for the gas lift operation without having to pass back through an additional stage of compression in the gas compressor. This also allows for elimination of downhole gas-lift valves, while retaining the standard industry compressor design that typically can only achieve pressures up to 1,315 psig.

To optimize the operation of the emissions recovery system, a series of float switches may be provided. A first float switch is located proximate a top of the first liquid piston chamber; a second float switch is located proximate a top of the second liquid piston chamber; and a third float switch is located proximate a bottom of the first liquid piston chamber. As the level of fluid changes within the respective chambers, the levels are detected by the float switches. Electrical signals indicative of those changes are sent to a processor.

In one aspect, the first float valve is configured to send a first signal when the liquid level in the first liquid piston chamber reaches a designated level near the top. Similarly, the second float valve is configured to send a second signal when the liquid level in the second liquid piston chamber reaches a designated level near the top. These signals prompt the processor to change a state of the switch valve in the pump.

Additionally, the third float valve is configured to send a third signal when the liquid level in the first liquid piston chamber reaches a near-minimum level. This signal prompts the processor to reintroduce fluid accumulated in the reservoir when the level in the first liquid piston chamber is too low. This prevents the pump from running out of fluid before the liquid level reaches the second float valve.

It is observed that the third float valve may be located proximate the bottom of either the first or the second liquid piston chamber. The third float valve serves a control function, which is keeping the right amount of liquid pumping back and forth from chamber to chamber.

As the processor receives signals indicative of fluid levels in the respective chambers, it is able to intelligently determine when the piston motion in each of the liquid piston chambers has substantially expelled all vapor from its respective chamber. The processor is then able to send control signals to control the position of the switching valve at the pump. This, in turn, maximizes efficiency of the gas compressor system.

The emissions recovery system additionally includes a gas transfer line. The gas transfer line receives the gas discharged from the reservoir and delivers it back to the gas compressor. Alternatively, the gas transfer line delivers the discharged gas to the backside of the wellbore from whence the gas was originally produced.

A method of recovering emissions from a compressor at a production site is also provided herein. The method employs the emissions recovery system described above in its various embodiments. The emissions recovery system receives fugitive gas emissions from the crank case of the compressor, and re-compresses them using unique dual liquid piston chambers.

The method first comprises providing a wellbore. The wellbore has been formed for the purpose of producing hydrocarbon fluids to the surface in commercially viable quantities. Preferably, the well primarily produces hydrocarbon fluids that are compressible at surface conditions, e.g., methane, ethane, propane and/or butane. In one aspect, the wellbore has been completed horizontally.

The method also includes providing a compressor associated with the wellbore. The compressor is configured to inject a compressible fluid into the wellbore in support of a gas lift operation. Preferably, injection occurs at a back side, or "annulus," of the wellbore. In one aspect, at least some of the gas is injected down to a depth of a bottom or distal end of a string of production tubing.

The method also includes producing hydrocarbon fluids from the wellbore. In connection with production, the produced fluids are separated into vapor and liquid components. A portion of the vapor components are directed into the compressor.

In one optional embodiment, the method next includes fitting the emissions recovery system described above to the compressor. In the system, vapors from the gas compressor crank case can be routed to the first liquid piston compressor at a suction header. Any fugitive vapors from a lubrication oil blow case, a dehydrator blow case, or a skid rainwater blow case may also be directed to the emissions recovery system at the suction header. This serves to eliminate various fugitive emission points near the well site.

In one aspect, the method includes incorporating a pressure transducer at the suction header that senses the pressure inside the header in real time. If pressure inside of the header becomes higher than a value deemed efficient for the compressor system, an operator can check the well site to determine why excess gas is escaping from the gas compressor crank case or other sources.

The method next comprises directing the gas emissions into the double-acting liquid piston compressor of the emissions recovery system. Specifically, gases are directed through the header and into each of the first liquid piston compressor and the second liquid piston compressor. The fugitive gas emissions are pressurized using piston action of the double-acting liquid piston compressor chambers. In accordance with the method, the liquid piston compressor system comprises a micro-processor configured to provide at least 95% (and, more preferably, at least 99%) Volumetric Efficiency for the piston action. The micro-processor receives pressure data from inside the header, and uses it to control the liquid flow rate between the liquid piston compressor chambers to establish a stable pressure. In this way, gas compression capacity is controlled.

In one aspect, the compressor is configured to pressurize and discharge the vapor components for injection into the wellbore in further support of the gas-lift operation. In this instance, the method further comprises injecting the pressurized fugitive gas emissions into the wellbore along with the vapor components captured from a production separator in support of the gas lift operation. Alternatively, the method may not include the compression of fugitive gas emissions, but only compressor discharge vapor components at high pressure.

In one aspect, a volume of gas compressed by the liquid piston compressor is calculated. This may be based upon the displacement of each liquid piston chamber (or compressor cylinder), the number of "strokes" by the piston chambers, and the estimated gas pressure and temperature inside the chambers at the beginning of each stroke. Since natural gas has a miniscule solubility in water, ideal gas law can be used to calculate the actual gas volume.

The micro-processor may additionally track the daily number of cycles for the purpose of creating an indicator of rod packing condition, with new packing being used as a baseline.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
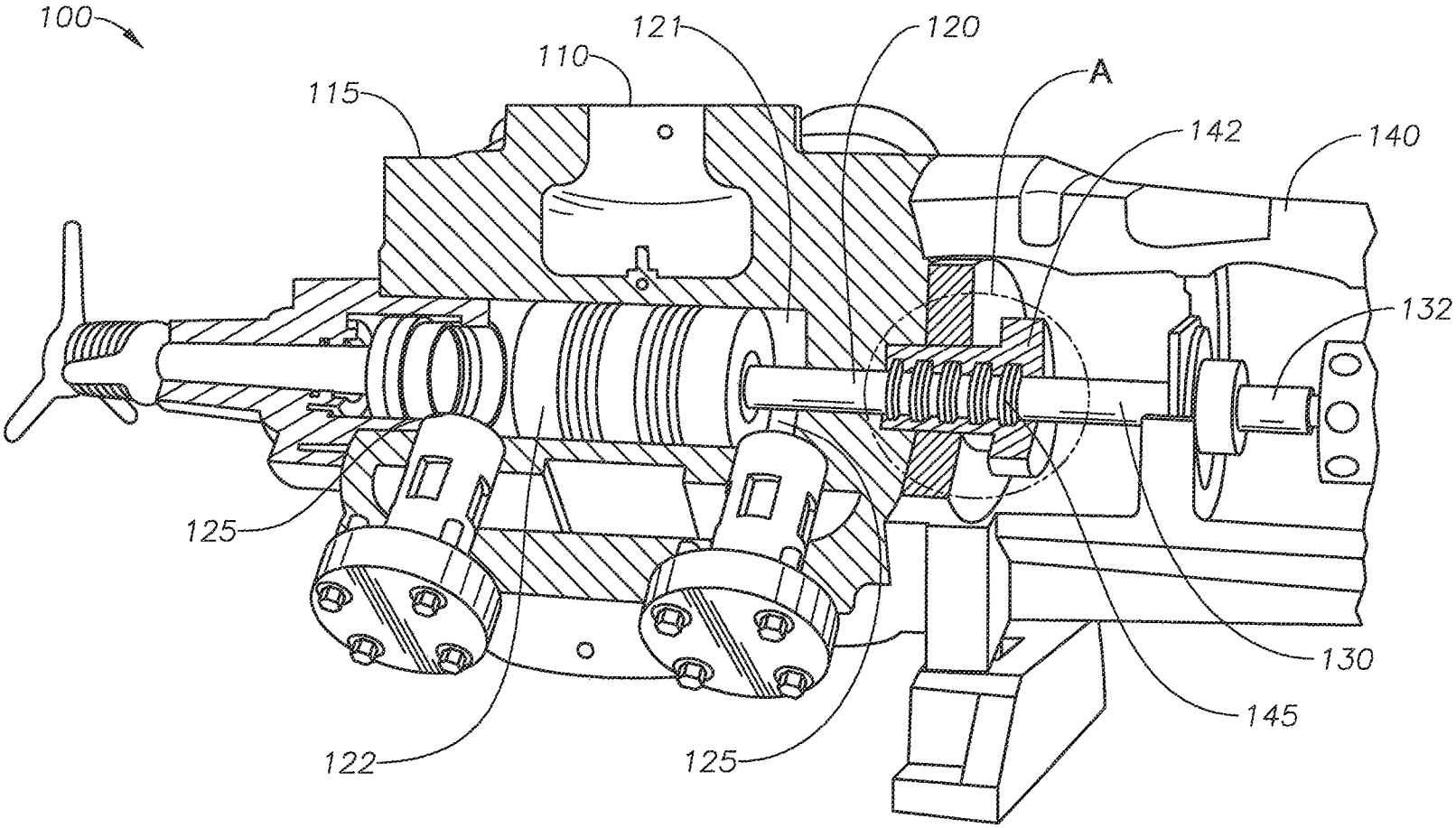
FIG. 1 (Prior Art)
FIG. 1 is a cut-away view of a known gas compressor. The illustrative gas compressor is a double-acting compressor having two gas inlets and two gas outlets, one each on either side of a piston. A crank shaft with packing rings is shown in this cut-away view.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and fines, combinations of liquids and fines, and combinations of gases, liquids, and fines.

As used herein, the term "wellbore fluids" means water, hydrocarbon fluids, formation fluids, or any other fluids that may be within a wellbore during a production operation.

As used herein, the term "gas" refers to a fluid that is in its vapor phase. "Gas" may be referred to herein as a "compressible fluid."

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore." The term "bore" refers to the diametric opening formed in the subsurface by the drilling process, or to the cylindrical opening along a pipe string.

Description of Selected Specific Embodiments

FIG. 1 is a cut-away view of a known gas compressor 100. The illustrative gas compressor 100 is a double-acting compressor as is commonly used in the upstream oil and gas industry for the purpose of moving gas through lines under pressure. Frequently such lines are small injection lines used to inject light hydrocarbons back into a wellbore in support of gas lift operations. In one aspect, the wellbore produces primarily gas, with diminishing liquid production. In one aspect, produced fluids may have a GOR in excess of 500 or, more preferably, above 3,000.

The compressor 100 is configured to receive a stream of fluids in the vapor phase. The fluid is typically obtained through a separation process at or near a well. In this respect, hydrocarbons are produced from the wellbore of the well and to the surface. The fluids enter one or more separators where gas (or compressible components) is separated from the fluids.

Liquids are moved downstream for further processing while the separated gas is transported for sale. A portion of the light hydrocarbons is moved to a gas inlet 110. The gas enters a piston housing 115 via two inlet check valves (see curved valve 121) where a double-acting piston 120 resides. The piston 120 reciprocates rapidly in response to rotational movement of a crank shaft 132. Gas injected into either side of the piston 120 within the piston housing 115 gets compressed. The compressed gas then exits the piston housing 115 through two outlet check valves 125 which are connected to a single gas outlet.

The piston 120 is moved linearly by a piston rod 130. The piston rod 130 reciprocates along an elongated bore, or channel 135, that resides within a crank case 140. The crank shaft 132 within the crank case 140 converts rotational movement of the crank shaft 132 into the reciprocating linear movement of the piston rod 130, as will be understood by those of ordinary skill in the art.

Figure 2:
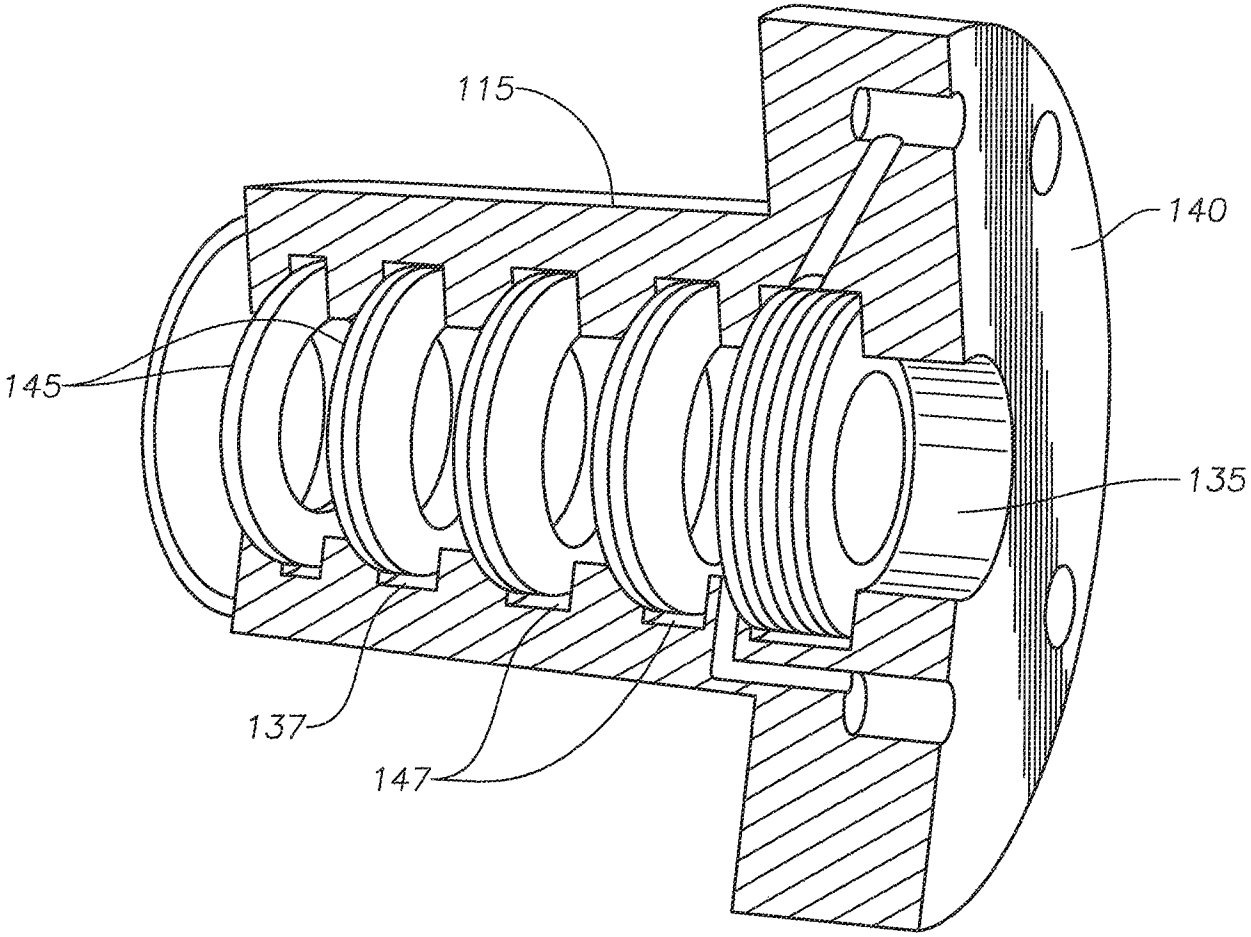
FIG. 2 (Prior Art)
FIG. 2 is an enlarged, cut-away view of a portion of the gas compressor of FIG. 1. Here, a portion "A" of the crank case is shown, with packing rings. The crank shaft has been removed for illustration.

Piston rod packings 145 are placed around the piston rod 130 and the surrounding channel 135. The rod packings 135 define o-rings, or packing seals. FIG. 2 is an enlarged, cut-away view of a portion "A" of the gas compressor 100 of FIG. 1. Here, the channel 135 where the piston rod 130 would otherwise reside is shown along with the surrounding rod packings 145.

The rod packings 145 define o-rings, and reside within annular spaces 137 formed between the piston rod 130 and the channel 135. Preferably, the rod packings 145 (or packing seals) are secured within circular slots 147 formed within the housing 142 of the crank case 140 to prevent lateral movement during operation of the compressor 100.

Returning to FIG. 1, the compressor 100 also includes two outlet check valves 125. In the arrangement of FIG. 1, the outlet check valves 125 are connected to a single gas outlet. The compressor 100 also includes two inlet check valves (one being visible at 121) in fluid communication with a common gas inlet 110. The gas inlets 121 and the gas outlets 125 reside along the piston housing 115. The two respective gas inlets 121 and the two respective gas outlets 125 are placed at opposite ends of the piston stroke. In this way, gas is both received and compressed while the piston end 122 strokes in both directions.

The packing rings 145 are lubricated during operation. An oil line (not shown) feeds a clean oil to facilitate movement of the piston rod 130 through the seal provided by the rings that make up the packing seal 145. However, experience has shown that over time the packing seal 145 will degrade due to the combination of heat and friction, causing a leakage of gas into the crank case 140. This is true for both conventional segmented (or cut) rings, and for un-cut rings.

One study has estimated that even new packing seals can experience leakage rates of 0.1 to 0.17 SCFM, with 1.7 to 3.4 SCFM for "alarm" points. This equates to 2.5 to 5.0 MSCFPD. Using Eagle Ford gas with a molecular weight of 22 at the higher rate of 3.4 SCFM, this represents lost gas of 13.2 lb.-moles per day, or 290 pounds per day, or 53 tons per year for a single packing case. This is in excess of normally permitted levels. In addition, many well site gas compressors have two of these packing seals, each of which will likely leak at least some gas, creating "fugitive emissions."

Figure 3:
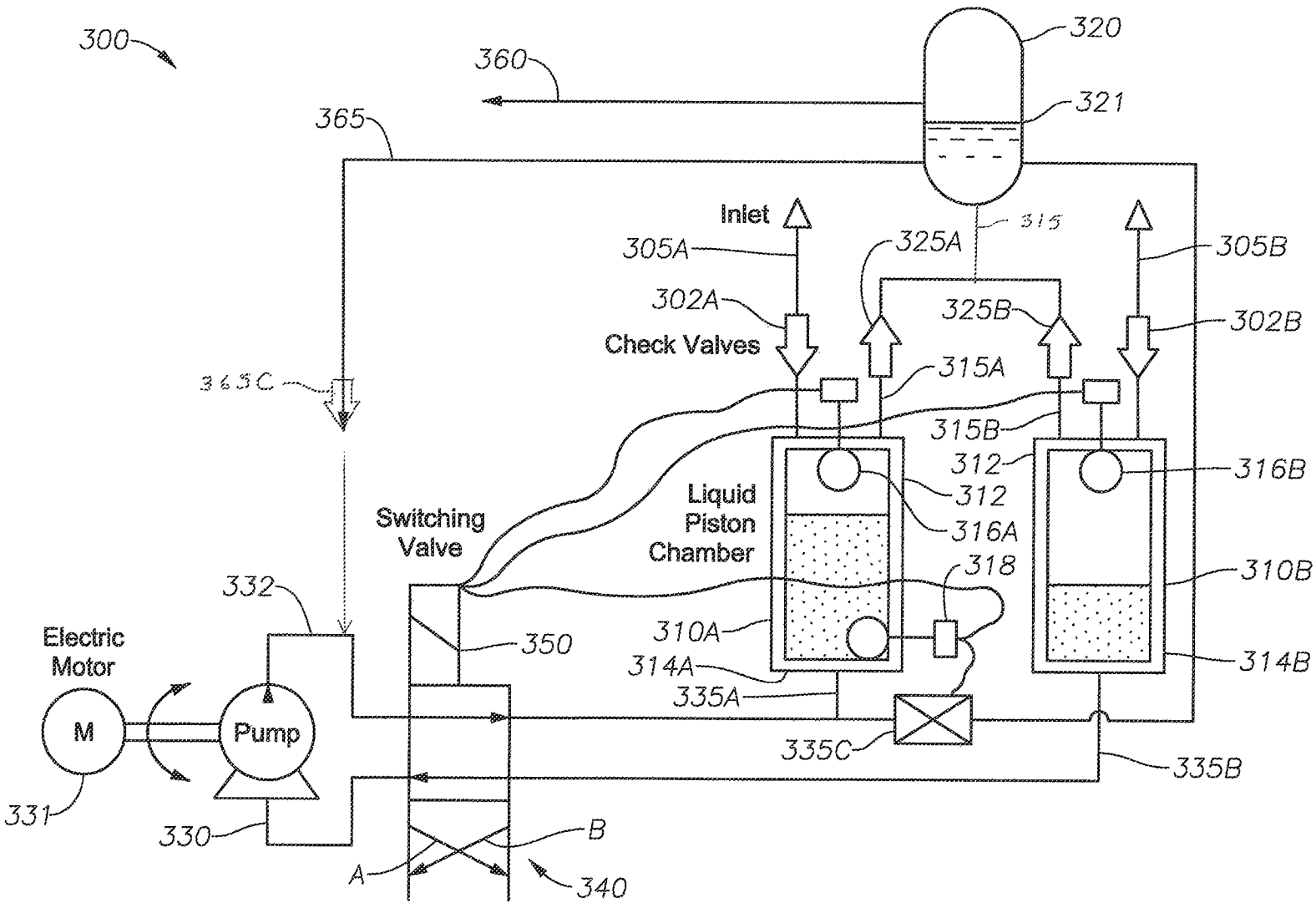
FIG. 3 is a schematic view of a dual liquid piston compressor system of the present invention, in one embodiment.
Figure 4:
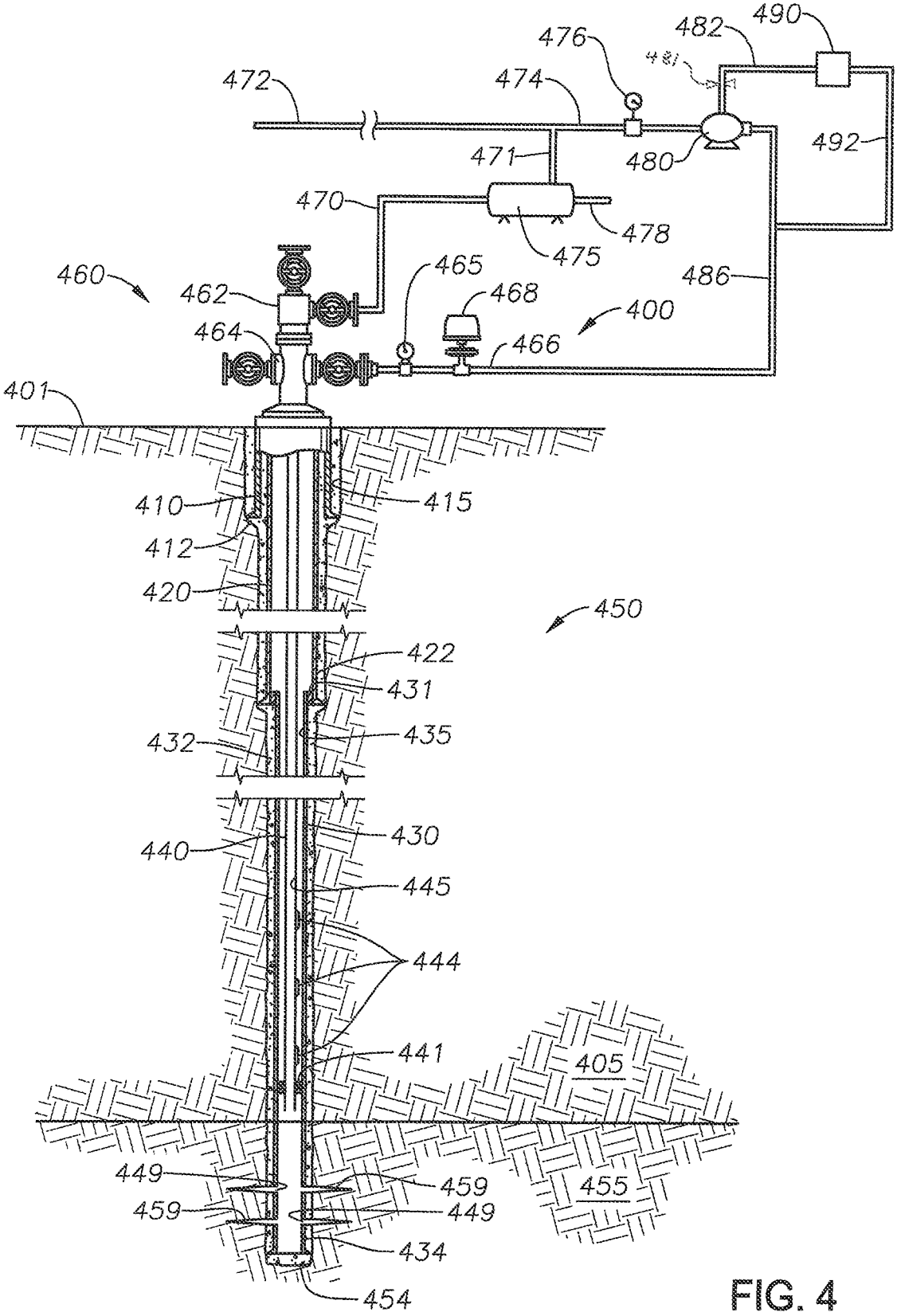
FIG. 4 is a cross-sectional view of a wellbore injecting compressed vapors down an annulus in support of a gas lift operation. A portion of those vapors may optionally be recovered emissions from a gas compressor used for the injection of the compressed vapors.

The vapor emissions may be captured by providing an outlet in the crank case 140 coupled with a vapor emissions line (seen at 305A in FIG. 3 and at 482 in FIG. 4). In the present invention, the vapor emissions are transported to a vapor emissions recovery system.

FIG. 3 is a schematic view of a gas emissions recovery system 300 of the present invention, in one embodiment. In essence, the gas emissions recovery system 300 comprises a double-acting liquid piston compressor. Dual liquid piston chambers 310A, 310B are used to pressurize fugitive vapors for re-injection into the gas compressor 100. In this way, the vapors are not released to the atmosphere and the value of the cumulative vapors is not lost.

The emissions recovery system (or dual liquid compression system) 300 first includes a gas emissions recovery line 305A. The gas emissions recovery line 305A comes from the suction header that is attached to the crank case 140 or other housing portion of the gas compressor 100 (or other fugitive gas emission source). The recovery line 305A transports fugitive gas emissions from the crank case 140 to the recovery system 300. A one-way check valve 302A resides along the recovery line 305A, keeping gas moving towards the system 300.

It is noted that the line pressure of the recovery line 305A is very low, such as at 12 psia. At this pressure, gas may move at a rate of, for example, 0.2 SCFM. Beneficially, the system 300 is able to receive gas at this very low rate, and then pressurize the gas up to, for example, 100 psi.

The emissions recovery system (or dual liquid compression system) 300 next comprises a pair of liquid piston chambers. These represent a first chamber 310A and a second chamber 310B. Each chamber 310A, 310B defines a cylindrical vessel that is partially filled with a compressible fluid. The compressible fluid is preferably brine, potable water, or water mixed with anti-freeze. The volume of fluid in each chamber 310A, 310B fluctuates up and down in inverse proportion as the system 300 is operated.

Each chamber 310A, 310B is preferably an ASME code-rated vessel. In one embodiment, each chamber 310A, 310B will "neck down" at the top 312 and bottom 314 ends. This facilitates the operation of upper float switches 316A, 316B and a lower float switch 318 which will be discussed further below. However, standard air tanks such as a 30-gallon, 200-psi tank made by SteelFab and offered by Compressor World may be utilized.

Each liquid piston chamber 310A, 310B has a fluid discharge line 315A, 315B. The respective discharge lines 315A, 315B extend up from an upper end, or top 312, of the chambers 310A, 310B. When the liquid level rises in one of the chambers 310A, 310B, gas is pushed out of the chamber 310A, 310B and into a respective discharge line 315A, 315B. Some water may incidentally be pushed out as well.

Each discharge line 315A, 315B is in fluid communication with a shared fluid reservoir 320. The lines may optionally merge into single line 315. A one-way check-valve 325A, 325B is placed along each of the discharge lines 315A, 315B, permitting vapor to be pumped from (but not back into) its corresponding liquid piston chamber 310A, 310B. Thus, vapor is retained in the reservoir 320 as a result of the piston action created by movement of the water levels.

It is noted that because some water is incidentally pushed into the reservoir 320 during the piston action, the reservoir 320 serves as an auxiliary fluid separator, or water trap. A water line 321 is shown in the illustrative reservoir 320, indicating an interphase between liquid and gas.

During operation, both vapor components and working fluid, e.g., water, will cyclically flow through the fluid discharge lines 315A, 315B and into the reservoir 320. The vapor components will be vented out of the top of the reservoir 320, and will then exit through a gas return line 360. At the same time, excess working fluid will drop out of the bottom of the reservoir 320 and exit through fluid return line 365.

One important aspect of the emissions recovery system (or dual liquid compression system) 300 is the re-introduction of the working fluid accumulated in the reservoir back into the pump intake through valve 335C. Line 365, located between fluid reservoir 320 and valve 335C, directs working fluid back to the fluid pump 330. This is done automatically when level detector 318 senses low fluid level. This prevents the pump 330 from running out of fluid before the liquid level reaches the second float valve 316B.

In one aspect, the compressor system 300 is configured to direct incompressible working fluid from the fluid reservoir 320 back into the pump 330 to pump fluid into the second liquid piston chamber 310B if (i) the second float valve switch 316B is unable to sense a water level proximate a designated level near the top of the second liquid piston chamber 310B, or (ii) the third float valve switch 318 senses a designated low fluid level.

Vented gas is routed from line 360 back to an inlet header 110 of the compressor 100, while the working fluid (such as water) is routed from line 365 to an inlet 332 of the pump 330. This arrangement allows for a full (99-100%) VE of the compressor system 300.

It is noted here that for purposes of the present inventions, the term "pump inlet" includes any line leading into the pump 330. A dedicated pump inlet 332 is not required for the water return line 365; rather, any point in the liquid pumping system is appropriate for the pump inlet. Of interest, a check valve 365C may be placed along line 365 to ensure the flow of excess working fluid back into the pump 330.

Each liquid piston chamber 310A, 310B also has a fluid release line 335A, 335B. The respective fluid release lines 335A, 335B extend down from a lower end, or bottom 314A, 314B, of the chambers 310A, 310B. When the fluid level in one of the chambers 310A, 310B drops, water flows (or is pushed) out of the chamber 310A, 310B and into a respective fluid line 335A, 335B.

Each fluid release line 335A, 335B is in fluid communication with a shared pump 330. A switch valve 340 is placed along the pump 330 to control a direction of water flow (or flow of incompressible working fluid) to and from the liquid piston chambers 310A, 310B. In this respect, the pump 330 alternately pumps water from the first chamber 310A to the second chamber 310B (when the switch valve 340 is in an "A" position), and then from the second chamber 310B back to the first chamber 310A (when the switch valve 340 is in a "B" position). Thus, the switch valve 340 is configured so that as the incompressible is fluid is leaving one of the liquid piston chambers, it is entering the other liquid piston chamber, forming a dual "piston" action.

It is noted that the pump 330 may be any conventional liquid pump. The pump 330 preferably includes an electric motor 331 that turns a shaft or moves bellows. Where water is used as the working fluid, then a reliable pump 330 for use in the system 300 may be a centrifugal pump. The centrifugal pump should have a control valve on the discharge to maintain a stable rate. To achieve the desired pressures at reasonable efficiencies, a multi-stage pump such as a Grundfos CRE or a Goulds equivalent may be considered. A Grundfos CR3-10 stage pump delivers 230 feet of heat (100 psi if using fresh water) at 15 GPM, using about 1.5 HP.

An alternative pump 330 may be a bank of eight 1.8 GPM Shurflo® Model 8000 High Pressure diaphragm pumps. Shurflo® is a brand name of Flow Technologies Group owned by Pentair, Inc. of Minneapolis, Minn. Shurflo® has offices in Costa Mesa, Calif. Certain of the Shurflo® pumps are rated at 100 psi. Pump rate is determined by the number of pumps that are operating at a given time. For example, two pumps may generate 3.6 GPM, while eight pumps would generate 14.4 GPM. The Shurflo® pumps can run dry without being damaged. Further, a controller 350 can spread the running hours evenly among several pumps, since initial rates in the 1-2 pump range are expected. The 12-volt model of the Shurflo® pump pulls up to 8.7 amps, so even eight Shurflo® pumps could be operated off of a standard compressor engine alternator.

As an alternative to water, a synthetic oil may be used as the working fluid. This assumes that working temperatures are kept elevated to prevent absorption of hydrocarbon components by the oil. In this instance, a gear pump may be selected as the pump 330. Gear pumps offer the advantage of a constant flow rate regardless of discharge pressure.

In any embodiment, the pump 330 alternately causes water to enter and to leave the respective chambers 310A, 310B, forming the dual-piston action. The piston action of the liquid piston chambers 310A, 310B serves to force natural gas that enters the liquid chambers 310A, 310B to be pumped into the reservoir 320. As the piston motion takes place, pressure builds within the reservoir 320 until it meets the pressure required to deliver the compressed gas into the downstream piping leading either to the compressor inlet or to a wellhead injection point (shown at 466 in FIG. 4). The result is that a relatively small pump 330 moving a relatively small volume of incompressible fluid between the liquid piston chambers 310A, 310B can generate a considerable amount of gas pressure. This pressure allows the vapor phase fluid released from the reservoir 320 to re-enter the original gas compressor 100. Ultimately, a vast majority of the fugitive vapors from vapor recovery line 305A will re-enter the wellbore from whence it was produced.

To optimize the operation of the system 300, a series of float switches may be provided. A first float switch 316A is located proximate the top 312 of the first liquid piston chamber 310A. A second float switch 316B is located proximate the top 312 of the second liquid piston chamber 310B. Finally, a third float switch 318 is located proximate a bottom 314 of the first liquid piston chamber 310A, although it is observed that the system 300 may function equally well if the third float switch 318 is located proximate a bottom 314 of the second liquid piston chamber 310B. (This would require changing the location of valve 335C to line 330 though)

As the level of incompressible fluid changes within the respective chambers 310A, 310B, the levels are detected by the float switches 316A, 316B, 318. Electrical signals indicative of those changes are sent to a processor 350. The processor 350, in turn controls the position of the switch valve 340. The processor 350 may be, for example, a Triangle Research Nano-10 having two analog inputs, four digital inputs, and four digital outputs.

The controller 350 represents a micro-processor having various components (not shown). These may include a printed circuit board, digital inputs (or pins) with a high speed counter, an analog input/output card, and a bus port. The controller 350 may also include an expansion port and digital outputs. Finally, the controller 350 may have an LCD interface and optional display, or may have a transceiver for communicating operating state through a wireless communications network.

In one aspect, the first float switch 316A is configured to send a first signal to the micro-processor 350 when the liquid level in the first liquid piston chamber 310A reaches a near-maximum level. Similarly, the second float switch 316B is configured to send a second signal to the micro-processor 350 when the liquid level in the second liquid piston chamber 310B reaches a near-maximum level. Additionally, the third float switch 318 is configured to send a third signal to the micro-processor 350 when the liquid level in the first liquid piston chamber 310A reaches a near-minimum level. The processor 350 receives these signals and, in response, sends control signals to control the position ("A" or "B") of the switching valve 340 at the pump 330.

The first 316A and the second 316B float switches are vertical float switches. These switches 316A, 316B reside at the top 312 of the corresponding piston chambers 310A, 310B and detect when most or all of the fugitive gas has been displaced from the chambers 310A, 310B. In one embodiment, the float switches 316A, 316B are LV-40/50 high-temperature liquid level switches available from Omega Engineering. Omega Engineering is a subsidiary of Spectris plc of Egham, England. The LV-40/50 float switch is rated up to 750 psi and may reside at the top of the vessels 310A, 310B in a 3" tee, with fluid exiting from the side of the tee. Another option for the float switches 316A, 316B is the Murphy MLS-020 switch. In the case of high-pressure compression, the float switches may be Norriseal 1001A, which is rated to 6,000 psi.

The third float switch 318 is a low-level switch added to one of the chambers (in FIG. 3, chamber 310A). This lower float switch 318 serves an important process control function, that of keeping just the right amount of liquid pumping back and forth from chamber to chamber. If too much fluid is present in either of the chambers 310A, 310B, it will "exhaust" with the gas through the discharge lines 315A, 315B and into the reservoir 320. On the other hand, if too little fluid is present in either of the chambers 310A, 310B, it will cause the system 300 to refill from the reservoir 320 back into the pump suction. Fluid return line 365 brings the liquid from the reservoir 320 back to the pump inlet 332.

As noted above, the emissions recovery system (or dual liquid compression system) 300 additionally includes a gas return line 360. The gas return line 360 receives the gas discharged from the reservoir 320 and delivers it back to the gas compressor 100 at or near the inlet 110. The gas compressor 100 increases the pressure of the returned fugitive vapors along with input gas, and releases an injection gas. The injection gas is primarily a light hydrocarbon gas, such as methane, ethane, propane, or combinations thereof. Alternatively or in addition, the injection gas includes other compressible components such as nitrogen, argon, oxygen, sulfuric components or combinations thereof. The present inventions are not limited to the type of gas injected unless expressly stated in the claims.

The injection gas is injected back into the wellbore (shown at 400 in FIG. 4) in support of a gas lift system. In one aspect, the injected compressible fluid is composed primarily of produced gases. In an alternative arrangement, the gas transfer line 360 delivers the discharged gas directly to the backside (or annulus) of the wellbore from whence the gas was originally produced, without going back to the compressor 100. Alternately, the compressor 100 is not in gas-lift service, but in gas sales service, and fugitive emissions are sold.

It is observed here that the emissions recovery system 300 utilizes what might be referred to as a liquid piston compressor system. A liquid piston compressor system such as what is described above is essentially the opposite of a so-called "blow case." In a blow case, a high pressure gas source is directed on top of a low pressure liquid, forcing the liquid down through a fluid outlet into a medium pressure system. The high pressure gas is then discharged into the low pressure system, allowing low pressure liquid to enter again. In this manner, batches of fluid are removed from a low pressure system into a higher pressure system, using compressed gas as the driver.

The liquid piston compressor operates in an opposite arrangement. In this respect, the liquid piston compressor uses a higher pressure liquid to compress a lower pressure gas, and then discharge the gas out of the top of the compressor cylinder into a medium pressure system (that is, a return line 360). In the present system 300, fugitive gas emissions enter the first chamber 310A through an inlet check valve 302A, and are then expelled from the first chamber 310A through check valve 325A along discharge line 315A. This is done as a result of a piston action of the water level in the first chamber 310A moving down and then up.

In operation, as the pump 330 is filling the first chamber 310A with water, the gas above the rising water line is pressurized. This gas is forced into the fluid reservoir 320 through check valve 325A. At the same time, a void is being created in the second cylinder 310B as the water level in that cylinder 310B decreases, creating a vacuum. A gas emissions intake line 305B is provided at the top 312B of the second chamber 310B. Gas emissions are drawn into the second chamber 310B through the intake line 305B. A check valve 302B is provided, preventing gas from being expelled back through intake line 305B during compression, but instead forcing the drawn gas through the second discharge line 315B and into the reservoir 320.

Once the first float switch 316A detects that the water level in the first chamber 310A has reached a designated point near the top 312, the flow direction will reverse. The check valve 325A on the first discharge line 315A will close, preventing the pressurized gas from re-entering the first chamber 310A. Once the pressure inside chamber 310B exceeds that of the reservoir 320, the check valve 325B on the second discharge line 315B will open, allowing gas to enter the reservoir 320 for the remainder of the second cylinder 310B compression cycle. At the same time, fugitive vapors are pulled from recovery line 305A through the inlet check valve 302A, bringing new gas into the first chamber 310A. Once all the gas has been discharged from the second chamber 310B, the flow direction of pumping will once again reverse, and the gas in the first chamber 310A will again be compressed as incompressible fluid is pulled from the second chamber 310B and back to the first chamber 310A.

This cycling process continues, with the pump 330 operating at a speed needed to handle the gas. For discussion purposes, assuming no pressure drop across the inlet check valve 302A, to compress 2 acfm (2 SCFM at 60 degrees and atmospheric pressure), this would equate to a pump rated at 15 GPM, given that there are 7.49 gallons in a cubic foot. Likewise, to compress 0.2 acfm, it would require a pump output of 1.5 GPM. For a discharge pressure of 100 psig and fresh water, this equates to 0.875 HP (for 2 acfm) and 0.0875 HP for 0.2 acfm, respectively. This number would have to be increased by whatever the expected pump efficiency would be.

It should also be mentioned that the pump discharge pressure will begin each cycle at the pressure of the suction header, and end at full discharge pressure. This is a function of pump rate and compression ratios. The liquid piston compressor 300 arrangement described above can attain a high compression ratio. For example, if we assume a 2.5 psi loss through the inlet check valves 302A, 302B, yielding an inlet pressure of 12 psia, a compression ratio of ten will result in 120 psia discharge pressure, or 105 psig. Due to the isothermal nature of the liquid piston compressor (where heat is transferred to the fluid during compression), the amount of work needed to compress the gas is beneficially reduced.

In one aspect, the size of the fluid pump 330 and the volume of incompressible fluid in the two liquid piston chambers 310A, 310B are up-scaled. Instead of having a suction header pressure near 12 psia and a discharge pressure of 120 psia, the suction pressure could be 1,000 psi with a discharge pressure of 2,000 or even 4,000 psi. This allows the stream of compressed gas from the gas compressor to be further elevated in pressure, and then directed back into the wellbore for the gas lift operation without having to pass back through an additional stage of compression in the gas compressor 100. This aspect allows for elimination of downhole gas-lift valves, while retaining the standard industry compressor design that typically can only achieve pressures up to 1,315 psig.

The liquid piston compressor of the gas emissions recovery system 300 can also be adapted to irregularly shaped vessels, such as a tube bundle mounted vertically, or a conventional compressed air tank. The process controls will be designed to look for fluid at the top outlet of the compression vessels 310A, 310B, assuring that all gas is removed from the vessel each cycle. There is no wasted compressor capacity from a pressurized clearance area, unlike conventional gas compressors that allow the gas to expand before the suction valve 302A can reopen.

It is noted that during normal operation as depicted with liquid being pumped from the second (or right side) chamber 310B into the first (or left side) chamber 310A, the switch valve 340 will operate when the top float switch 316A in the first chamber 310A senses a high level. However, when pumping from the first chamber 310A into the second chamber 310B, in addition to the top float switch 316B in the second chamber 310B sensing a high level, the lower float switch 318 in the first chamber 301A must sense a low level.

If the top float switch 316B in the second chamber 310B senses a high level of water before the lower float switch 318 in the first chamber 310A senses a low level of water, then there is excess fluid in the system 300. The processor 350 will allow the excess fluid to exit the second chamber 310B along with the compressed gas until the low float switch 318 drops.

To achieve this purpose, the reservoir 320 is configured to function as an auxiliary liquid trap. In this respect, the reservoir 320 is able to separate gas from the process liquid. The reservoir 320 is designed to receive any excess liquid that may be released from the second chamber 310B during pump 330 operation. To this end, the processor 350 will allow the pump 330 to run until the lower float switch 318 detects a low fluid level in the first chamber 310A. During this additional run time ($t_r$), that is the time ($t_1$) when the upper float switch 316B detects that the second chamber 310B is filled until the time ($t_2$) that the lower float switch 318 detects that the first chamber 310A is empty, water is directed to accumulate in the reservoir 320.

If during ($t_r$) the top float switch 316B in the second chamber 310B does not sense a high level, yet the lower float switch 318 in the first chamber 310A does sense a low water level, there is not an adequate amount of compressible fluid in the system 300 to properly compress gas. In this case, a fill valve 335C residing below the lower float switch 318 will open until the top float switch 316B in the second (or right) chamber 310B no longer senses a high level. During this time ($t_f$) from when the lower float switch 318 senses a low fluid level ($t_1$) until the upper float switch 316B senses a full water level ($t_2$), the fill valve 335C will route fluid from the reservoir 320 back into the pump 330 through an appropriate line or through the pump inlet 332.

The reservoir (auxiliary liquid trap) 320 is preferably equipped with a sight glass so that an operator may monitor the liquid level. The reservoir 320 will never need to have a high level dump valve, but it may need to have a low level liquid fill valve in the event that the gas tends to evaporate the liquid. This depends on the liquid being used, the operating temperatures and the vapor pressures. As a practical matter though, the system 300 operates fine if a little water is sent into the compressor inlet, or even down the well casing.

As noted, the gas emissions recovery system also includes a controller 350. The controller 350 is used to optimize the gas pressurization process. The controller 350 receives, records and processes information from the first 316A, second 316B and third 318 float switches on the float positions. In one aspect, the controller 350 employs timers to delay switching of the switching valve 340 at the pump 330. This serves to intentionally over-displace the gas from each chamber 310A, 310B. The delay may be, for example, between 0.2 and 2.0 seconds. This complete high pressure gas removal insures there is not any delay in the inlet valve 302A or 302B opening to bring in new gas to compress.

It is observed that reciprocating compressors of any type typically have clearance volumes that will retain high pressure gas. In other words, not all gas is expelled from a piston chamber during the stroke. In known compressors, gas must expand fully and reach the inlet pressure in the compressor 100 before the inlet check valves will open. This reduces the capacity (VE or Volumetric Efficiency). In contrast, for the present emissions recovery system 300 design, delaying switching of the switching valve 340 at the pump 330 increases VE to at least 95%, and in practicality at least 99%, or near 100%. This is done by allowing the pump to continue to displace gas from each chamber 310A, 310B during their respective pumping cycles until all (or certainly the vast majority of) gas is pushed out. This is beneficial, even if a little liquid comes with the gas. (The liquid piston compressor will have 100% VE if this over-displacement occurs.) In the present gas emissions recovery system 300, the processor 350 is configured to provide at least 95% Volumetric Efficiency.

To enable the at least 95% VE (and preferably 99% or 100% VE), the reservoir 320 re-routes the displaced working liquid back into the pump 330. This is done through fluid return line 365. In a further adaptation, the duration of the over-displacement time delay will be tuned based upon the number of "strokes" of the liquid piston combined with the frequency of dumping liquid from the reservoir 320 back into the pumping process. Excessive over-displacement results in routing of liquid through the water return line 365 and back into the pump inlet 332.

In one embodiment, the duration of the over-displacement, or time delay, is tuned based upon the ratio of the number of "strokes" of the liquid piston to the frequency of "Fluid Return Events." A Fluid Return Event, or "FRE" occurs when fluid is dumped from the reservoir 320 back into the pump 300. Excessive over-displacement results in excessive FRE's. This, in turn, reduces the efficiency of the system.

An optimal number of strokes per FRE can be determined by watching the pressure drop when fluid begins filling a new chamber. A slow drop indicates that gas remains in the cylinder at the end of the stroke. This, of course, is not desirable as it indicates that not all gas is being pushed out of a chamber during a piston stroke. A quick pressure drop indicates that no gas remains in the cylinder at the end of the stroke, which in turn means a high VE.

An FRE algorithm may be provided that consists of counting the number of piston strokes between FRE's, and then comparing that number of strokes to a desired operator set point. The desired operator set point will be a number of strokes until an FRE occurs, but where a quick pressure drop is taking place during a fluid swap between the chambers. During testing of a scale model, setting the over-displacement timer at 1 second resulted in a ratio of 4 strokes per FRE. Reducing the over-displacement timer to 0.5 seconds increased the ratio to 10 strokes per FRE.

An algorithm for tuning the number of piston strokes between FRE's may be as follows:

[(Actual number of strokes per FRE)−(Operator input desired number of strokes per FRE)]*0.05 seconds=Change in over-displacement time delay Note that the 0.05 seconds is a somewhat arbitrary Time Adjustment value. This value may be changed to meet optimum operational needs.

In operation, if the actual number of strokes between FRE's is 8, but the desired number, or set point, is 6 strokes per FRE, then not enough fluid is being over-displaced, and FRE's are occurring less often than desired. The difference of 8−6=2 fewer strokes per FRE. This difference of 2 is then multiplied by, for example, a time gain of 0.05 seconds. The result is that 0.1 seconds is added to the over-displacement time:

[8 (actual)−6 (desired)]*0.05=0.1 seconds added to the existing over-displacement timer value If the very next FRE was accomplished in only 5 strokes, then 0.05 seconds would be subtracted from the over-displacement time:

[5 (actual)−6 (desired)]*0.05=−0.05

Other algorithms may be used to determine an optimal time delay to allow over-displacement. In one embodiment, a pressure transducer is placed in one of the liquid piston chambers 310A or 310B. The pressure transducer takes real time pressure measurements within the chamber. The microprocessor 350 times the pressure fall-off during fluid evacuation, expecting a 90% reduction in, say, less than 2 seconds.

In the case where a 90% reduction requires more than 2 seconds (indicating inadequate gas over-displacement), then the over-displacement timer value is increased by, for example, 0.1 seconds. This step is repeated as necessary until the desired 2 second fall-off is achieved. If a pressure fall-off of less than 2 seconds is achieved, then on each cycle, the over-displacement timer may be reduced by a small amount, say, 0.01 seconds.

In this embodiment, there would also be a dead band whenever the actual time was within, for example, ¼ second of the 2 second goal, where no timer changes would be made. This value may be saved as a process indicator. In one adaptation, this test would be performed once per day to protect the longevity of the pressure transducer, with the pressure transducer being isolated by a valve from the cylinder pressure when not in use.

In any arrangement, the controller 350 not only controls switching of the switching valve 340 at the pump 330, but may also control the liquid flow rate. Flow rate may be controlled based on the pressure in the inlet gas (or suction) header (near 305A and 305B). The controller 350 can calculate the volumes of gas compressed over a period of time.

The control method depends upon the type of pump 330 used, as well as the composition of the liquid employed. If the temperature of the working fluid is to be maintained at between 120° F. and 150° F., it is preferred that water be utilized as the working fluid for the liquid pistons. Temperatures below this risk condensing hydrocarbons, while temperatures above this risk high vapor pressures, potentially vapor locking the pump 330 or causing gas to migrate into the water.

It is noted that in connection with the gas emissions recovery system 300, four separate valves are used. These are the gas inlet valves 302A and 302B, and the gas outlet valves 325A and 325B. Valves 302A and 302B are suction valves while valves 325A and 325B are discharge valves. Only two valves at a time are normally actuated.

Each of these valves 302A, 302B, 325A, 325B is a one-way check valve. The switching valves 340 may instead be four solenoid valves; however, for the rugged environment at the well site, it is preferred that the switching valve 340 be a pair of three-way, air-operated motor valves due to the cycling and the chemicals involved.

In one embodiment of the gas emissions recovery system 300, pressure and temperature signals are also sent to the controller 350. For example, a pressure transducer may be provided along the gas inlet lines 305A, 305B to monitor pressure. The controller 350 would then control either the pump output using a VFD or choking the pump discharge with a control valve, or by controlling a pump bypass valve, to achieve the desired pressure in the suction header. Instead of a controller 350, it may be desirable to control inlet pressure below 2.5 psig using a pneumatic controller. Therefore, a control valve such as a Kimray AHK-2.5 pneumatic valve may operate either a pump discharge control valve, or a pump bypass valve in response to control signals that will limit suction header pressure.

Concerning temperature, Precon Thermistors may be used to monitor operating temperature within the chambers 310A, 310B, within the inlet lines 305A, 305B, within the outlet lines 315A, 315B, or elsewhere in the system 300. In one aspect, the fluid temperature and the outlet gas temperature are measured by attaching a thermistor using a zip tie to the piping surface, and then insulating to reduce the impact of ambient temperature conditions.

A single gas outlet temperature thermistor may be placed where the discharge from the two chambers 310A, 310B meets. A fluid temperature sensor may be placed on the piping downstream of the pump 330. This is useful for measuring temperatures from 10° F. to 180° F. The thermistor Model ST-MP3-R from Kele, Inc. of Memphis, Tenn. is preferred, along with a 0.2 amp fuse on the 5 volt thermistor power supply. Alternately, a thermocouple may be utilized.

In one arrangement, the three float sensors 316A, 316B, 318 are connected to three digital inputs of the controller 350. The two analog inputs can be connected to a compressor inlet header pressure transducer and to a temperature sensor to monitor for out-of-range temperatures. In the event that a VFD is used to control pump speed (and therefore compressor capacity), the speed signal can be communicated directly through the RS485 port. Alternately, an actuator can be used to position a choking motor valve on a centrifugal pump discharge or pump bypass, thereby controlling rate.

The gas compressor system 300 may be used in any application where low pressure gas is fed into a suction header, and where it is desired to increase an output of pressure. However, a preferred application is to use the pressurized gas output for direct injection into a wellbore annulus in support of a gas lift operation. The gas that is injected may or may not include so-called fugitive gas recovered from the housing or crank case of a gas compressor. In this respect, use of the liquid piston compressor herein may be independent of the use of gas from fugitive gas emissions.

The gas lift operation may be either a low pressure gas lift operation that utilizes traditional gas lift valves along a tubing string, or it may be a high pressure gas lift operation that injects gas down the backside of the wellbore and to the bottom of the production tubing.

FIG. 4 is a cross-sectional view of a well site 400 receiving compressed vapors down an annulus in support of a gas lift operation. The well site 400 includes a wellbore 450 extending from an earth surface (or, optionally, a sea floor) 401, and down into an earth subsurface 405. The illustrative wellbore 450 is completed for the purpose of producing hydrocarbons in commercially viable quantities from a hydrocarbon reservoir, or "pay zone" 455.

The wellbore 450 has been completed with a series of pipe strings, referred to as casing. First, a string of surface casing 410 has been cemented into the subsurface 455. Cement is shown in a generally cylindrical bore 415 of the wellbore 450 around the casing 410. The cement is in the form of an annular sheath 412. The surface casing 410 has an upper end in sealed connection with a lower valve 464.

Next, at least one intermediate string of casing 420 is cemented into the wellbore 450. The intermediate string of casing 420 is in sealed fluid communication with an upper valve 462. A cement sheath 422 is again shown in the bore 415 forming the wellbore 450. The combination of the casing 410/420 and the cement sheath 412/422 in the bore 415 strengthens the wellbore 450 and facilitates the isolation of formations and any aquifers behind the casing 410/420.

It is understood that a wellbore 450 may, and typically will, include more than one string of intermediate casing 420. In some instances, an intermediate string of casing may be a liner. It is also understood that the upper valve 462 and the lower valve 464 are part of a larger well head 460, which is somewhat schematically shown. The wellhead 460 will include various valves for controlling the flow of fluids into and out of the wellbore 450. The wellhead 460 will also include a liner hanger and one or more back-side access ports used for chemical injection, data cable entry, power lines and/or regulatory test access.

In addition, the wellbore 450 includes a production string 430. The production string 430 is hung from the intermediate casing string 420 using a liner hanger 431. The production string 430 is a liner that is not tied back to the surface 401. In the arrangement of FIG. 4, a cement sheath 432 is provided around the liner 430.

The production string 430 extends into the pay zone 455. The production string 430 has a lower end 434 that traverses to an end 454 of the wellbore 450. For this reason, the wellbore 450 is said to be completed as a cased-hole well.

The production string 430 has been perforated after cementing. Illustrative perforations are shown at 449. The perforations 449 create fluid communication between a bore 435 of the liner 430 and the surrounding rock matrix making up the pay zone 455.

The wellbore 450 finally includes a string of production tubing 440. The production tubing 440 extends from the wellhead 160 down to the subsurface formation 455. In the arrangement of FIG. 4, the production tubing 440 terminates above the perforations 449. However, it is understood that the production tubing 440 may terminate anywhere along the subsurface formation 455.

In one arrangement, the wellbore 450 includes one or more gas lift valves 444. The gas lift valves 444 reside along the production tubing 440 above a packer 441. The gas lift valves 444 receive gas injected into the annulus 435 between the production tubing 440 and the surrounding casing 430. The gas lift valves 444 then inject (or release) that gas into a bore 445 of the production tubing 440 for the purpose of reducing the density of the wellbore fluids.

Gas lift valves are used in a generally low-pressure application for gas lift. However, it is preferred that the present method is used in a high-pressure gas lift operation. In this instance, gas lift valves and a packer are not required or used. Instead, the liquid piston compressor will take a low pressure gas feed (such as at or just above ambient pressure), and inject it into the annulus at a much higher pressure, such as over 750 psi and, more preferably, over 1,000 psi. In one aspect, a low-pressure feed is at 10 to 50 psi, and the high pressure outlet that is injected into the wellbore annulus is between 1,000 psi and 1,800 psi.

In order to inject the gas, a gas injection line 466 is provided along the wellhead 460. The wellhead 460 includes a gauge 465 and a pressure regulator 468. Typically, the gas that is injected is separated gas that has been produced from the subsurface formation 455.

FIG. 4 shows a fluids line 470 extending from the wellhead 460. The fluids line 470 transports produced wellbore fluids, which will include both compressible and incompressible hydrocarbon fluids. The produced fluids line 470 may also include water along with possible $CO_2$ and sulfuric components.

The produced fluids in fluids line 470 are taken to a local surface separator 475. The surface separator 475 may be a gravitational separator, a so-called heater treater, or other separator. In the separator 475, gas is flashed off of the top through line 471, while liquids are carried from the bottom through line 478. The liquids will include both hydrocarbons and water, and will be carried downstream for further processing, refining and sale.

The gas released through line 471 is broken into two downstream lines—line 472 and line 474. Line 472 is a processing line, where light hydrocarbons are processed to remove impurities and to bring the gas into pipeline specifications for sale. For example, the released gas in line 472 may be taken to a cryogenic separator where $CO_2$ and $H_2S$ are removed. This represents the majority of produced compressible fluids.

A small portion of the produced gas is diverted to line 474. The gas in line 474 passes through a valve 476 having a pressure gauge, and is then delivered to a compressor 480. The compressor 480 pressurizes the gas for reinjection into the annulus 435 in support of gas lift operations. The gas compressor 480 is located at the surface 401 near the well site 400. The gas compressor 480 may be in accordance with the liquid piston compressor 300 shown in FIG. 3 and described above.

In one optional aspect of the present invention, the gas compressor 480 is in accordance with the conventional compressor 100 of FIG. 1. Fugitive gas emissions released from the compressor 480 are captured in line 482. These emissions are transported to a liquid piston compressor 490. While liquid piston compressor 490 is shown schematically in FIG. 4, it is intended to represent the controlled, double-acting liquid piston compressor 300 of FIG. 3, in any of its embodiments. Consistent with this arrangement, line 482 may represent line 305A of FIG. 3, or splits into inlet lines 305A and 305B of FIG. 3.

In any instance, gas in line 474 is released from the liquid piston compressor (480 or 490) at low pressures, such as at or just above ambient pressure. The liquid piston compressor operates to pressurize the low-pressure gas, up to, for example, at least 1,300 psig. The pressurized gas is released from the liquid piston compressor (such as compressor 490) through line 492. Line 492 represents gas return line 360 of FIG. 3. In the arrangement of FIG. 4, the gas in line 492 merges with pressurized gas in line 486, en route to gas injection line 466.

It is noted that the operator may choose not to capture fugitive gas emissions from compressor 480. To this end, a valve 481 along line 482 may be closed. In this instance, compressor 480 is a conventional gas compressor. As an alternative, compressor 480 may be a dual liquid piston compressor 300. In this instance, valve 481, line 482, compressor 490 and line 492 are removed from the system.

As the gas travels to the wellhead 460, the gas will pass through the regulator 468 and the pressure gauge 465. Gas is then injected under pressure into the annulus 435, and then through the one or more gas lift valves 444.

As can be seen, an improved fugitive emissions recovery system is offered. Using the system, a method of recovering gas emissions and re-injecting them for use in support of a gas lift operation is provided. Additionally, a double-acting liquid piston compressor having a VE of at least 95%, and up to 100% is disclosed. Further, a method of injecting a compressible fluid into a wellbore in support of a high-pressure gas lift operation is provided, wherein a double-acting liquid piston compressor is utilized to provide pressure for the gas injection line.

Further, variations of the method for compressing fugitive gas emissions or for injecting a compressible fluid into a wellbore may fall within the spirit of the claims, below.

It will be appreciated that the inventions are susceptible to modification, variation and change without departing from the spirit thereof.

I claim:

1. A gas emissions recovery system for a compressor, comprising:

a gas emissions recovery line extending from a housing of the compressor, the gas emissions recovery line configured to transport fugitive gas emissions from the housing of the compressor;

first and second liquid piston chambers configured to hold an incompressible working fluid and to receive the fugitive gas emissions from the gas emissions recovery line;

a fluid pump configured to alternatingly pump the incompressible working fluid into the first and second liquid piston chambers and, thereby, induce reciprocating piston action of the incompressible working fluid in the first and second liquid piston chambers;

a fluid reservoir configured to cyclically receive the fugitive gas emissions and excess working fluid from the first and second liquid piston chambers in response to the piston action of the incompressible fluid in the first and second chambers, thereby creating a pressurized gas;

a gas return line configured to deliver the pressurized gas from the fluid reservoir in response to the piston action in the first and second liquid piston chambers;

a first float valve switch placed proximate the top of the first liquid piston chamber;

a second float valve switch placed proximate the top of the second liquid piston chamber;

a third float valve switch placed proximate the bottom of the first liquid piston chamber;

a liquid return line configured to direct the excess working fluid from the fluid reservoir and into the pump automatically if the third float valve switch senses a designated low fluid level; and a processor configured to control pump times in the respective first and second liquid piston chambers based on position signals sent from each of the first, second and third float switch valves indicative of a level of working fluid, enabling the processor to provide at least 95% Volumetric Efficiency within the gas emissions recovery system.

2. The gas emissions recovery system of claim 1, further comprising:

a first gas inlet check valve placed along the gas emissions recovery line to direct gas into the first liquid piston chamber;

a second gas inlet check valve placed along the gas emissions recovery line to direct gas into the second liquid piston chamber;

a first fluid discharge line extending from a top of the first liquid piston chamber and having a first outlet check valve through which the fugitive gas emissions and excess working fluid are expelled from the first liquid piston chamber en route to the fluid reservoir; and a second discharge line extending from a top of the second liquid piston chamber and having a second outlet check valve through which the fugitive gas emissions and excess working fluid are expelled from the second liquid piston chamber en route to the fluid reservoir; and wherein the excess working fluid from the fluid reservoir is routed into piping in fluid communication with the pump en route to the pump.

3. The gas emissions recovery system of claim 2, wherein the processor is configured to control pump times so as to provide at least 99% Volumetric Efficiency within the gas emissions recovery system.

4. The gas emissions recovery system of claim 3, wherein:

the compressor resides proximate a hydrocarbon production wellbore;

the fugitive gas emissions comprise primarily hydrocarbon fluids produced from the wellbore;

the compressor is a gas compressor for re-injecting gas into a back side of the wellbore in support of a high-pressure gas lift operation; and the gas return line is configured to inject the fugitive gas emissions back into the wellbore in support of the high-pressure gas lift operation.

5. The gas emissions recovery system of claim 3, wherein:

the gas emissions recovery line operates at less than 5 psi;

the piston action increases pressure of the fugitive gas emissions to at least 50 psi; and the gas return line is configured to return the fugitive gas emissions to the gas being reinjected.

6. The gas emissions recovery system of claim 3, wherein:

the gas emissions recovery line operates at less than 5 psi;

the piston action increases pressure of the fugitive gas emissions to at least 100 psi;

the compressor is a gas sales compressor; and the gas return line is configured to return the fugitive gas emissions to the gas sales compressor.

7. The gas emissions recovery system of claim 3, further comprising:

a first fluid release line extending from a bottom of the first liquid piston chamber;

a second fluid release line extending from a bottom of the second liquid piston chamber; and a switch valve residing along the pump and configured to direct a flow of the incompressible working fluid between the first liquid piston chamber and the second liquid piston chamber in response to switching signals sent by the processor in order to create the piston action.

8. The gas emissions recovery system of claim 7, further comprising:

a pressure sensor along the gas emissions recovery line;

a first temperature sensor placed proximate an inlet along the reservoir that receives fugitive gas emissions expelled from the liquid piston chambers; and a second temperature sensor placed on piping associated with the pump.

9. The gas emissions recovery system of claim 7, wherein the incompressible working fluid is water or an aqueous solution with anti-freeze.

10. The gas emissions recovery system of claim 7, wherein:

the processor is configured to send a first switching signal to the switch valve to direct the incompressible fluid from the first liquid piston chamber to the second liquid piston chamber during pumping in response to receiving a "fill" signal from the first float valve switch that a level of working fluid has reached a level substantially at the top of the first liquid piston chamber; and the processor is further configured to send a second switching signal to the switch valve to direct the incompressible fluids from the second liquid piston chamber back to the first liquid piston chamber during pumping in response to receiving a "fill" signal from the second float valve switch that a level of working fluid has reached a level substantially at the top of the second liquid piston chamber, and further upon receiving a "confirmation" signal from the third float switch that the working fluid level in the first liquid piston chamber has dropped to a level substantially at the bottom of the first liquid piston chamber.

11. The gas emissions recovery system of claim 10, wherein the processor is further configured to:

delay sending the first switching signal to the switch valve by 0.2 to 2.0 seconds after receiving the "fill" signal from the first float valve switch to ensure full displacement of fugitive gas from the first liquid piston chamber; and delay sending the second switching signal to the switch valve by 0.2 to 2.0 seconds after receiving the "fill" signal from the second float valve switch (and the "confirmation" signal from the third float valve switch) to ensure full displacement of fugitive gas from the second liquid piston chamber.

12. The gas emissions recovery system of claim 11, wherein:

the delay in sending the first switching signal causes a portion of the incompressible working fluid to be expelled through the first discharge line and into the reservoir as a result of over-displacement of working fluid; and the delay in sending the second switching signal causes a portion of the incompressible fluid to be expelled through the second discharge line and into the reservoir as a result of over-displacement of working fluid.

13. The gas emissions recovery system of claim 12, wherein the compressor is further configured to direct the incompressible working fluid from the fluid reservoir back into the pump to pump fluid into the second liquid piston chamber if the second float valve switch is unable to sense a water level proximate a designated level near the top of the second liquid piston chamber.

14. A gas injection system for a wellbore, comprising:

a liquid piston compressor, comprising:

a gasfeed line;

first and second liquid piston chambers configured to hold an incompressible working fluid and to receive compressible hydrocarbon fluids from the gas feed line;

a fluid pump configured to alternatingly pump the incompressible working fluid into the first and second liquid piston chambers and, thereby, induce reciprocating piston action of the incompressible working fluid in the first and second liquid piston chambers;

a fluid reservoir configured to cyclically receive gas and excess working fluid from the first and second liquid piston chambers in response to the piston action of the incompressible fluid in the first and second chambers, thereby creating a pressurized gas;

a gas outlet line configured to deliver the pressurized gas from the fluid reservoir in response to the piston action in the first and second liquid piston chambers;

a first float valve switch placed proximate the top of the first liquid piston chamber:

a second float valve switch placed proximate the top of the second liquid piston chamber: and a third float valve switch placed proximate the bottom of the first liquid piston chamber:

a liquid return line configured to direct the excess working fluid from the fluid reservoir and into the pump automatically when (i) the second float valve switch is unable to sense a water level proximate a designated level near the top of the second liquid piston chamber, or (ii) the third float valve switch senses a designated low fluid level: and a processor configured to control pump times in the respective first and second liquid piston chambers based on position signals sent from each of the first second and third float switch valves indicative of a level of working fluid, enabling the processor to provide at least 95% Volumetric Efficiency within the gas injection system; and a gas injection line configured to inject the pressurized gas from the gas outlet line into a backside of the wellbore in support of a high-pressure gas lift operation.

15. The gas injection system of claim 14, wherein the liquid piston compressor further comprises:

a first gas inlet check valve configured to direct a first portion of the compressible hydrocarbon fluids from the gas feed line into the first liquid piston chamber;

a second gas inlet check valve configured to direct a second portion of the compressible hydrocarbon fluids from the gas feed line into the second liquid piston chamber;

a first fluid discharge line extending from a top of the first liquid piston chamber and having a first outlet check valve through which the gas and excess working fluid are expelled from the first liquid piston chamber and into the fluid reservoir; and a second discharge line extending from a top of the second liquid piston chamber and having a second outlet check valve through which the gas and excess working fluid are expelled from the second liquid piston chamber and into the fluid reservoir; and wherein the excess working fluid from the fluid reservoir is routed into piping in fluid communication with the fluid pump.

16. The gas injection system of claim 15, wherein:

the compressor resides proximate a hydrocarbon production wellbore;

and the processor is configured to control pump times so as to provide at least 99% Volumetric Efficiency for the piston action.

17. The gas injection system of claim 15, further comprising:

a first fluid release line extending from a bottom of the first liquid piston chamber;

a second fluid release line extending from a bottom of the second liquid piston chamber; and a switch valve residing along the pump and configured to direct a flow of the incompressible working fluid between the first liquid piston chamber and the second liquid piston chamber in response to switching signals sent by the processor in order to create the piston action.

18. The gas emissions recovery system of claim 17, further comprising:

a pressure sensor along the gas emissions recovery line;

a first temperature sensor placed proximate an inlet along the reservoir that receives fugitive gas emissions expelled from the liquid piston chambers; and a second temperature sensor placed on piping associated with the pump.

19. The gas emissions recovery system of claim 17, wherein:

the incompressible working fluid is water or an aqueous fluid mixed with an anti-freeze;

the processor is configured to send a first switching signal to the switch valve to direct the incompressible fluid from the first liquid piston chamber to the second liquid piston chamber during pumping in response to receiving a "fill" signal from the first float valve switch that a level of working fluid has reached a level substantially at the top of the first liquid piston chamber; and the processor is further configured to send a second switching signal to the switch valve to direct the incompressible fluids from the second liquid piston chamber back to the first liquid piston chamber during pumping in response to receiving a "fill" signal from the second float valve switch that a level of working fluid has reached a level substantially at the top of the second liquid piston chamber, and further upon receiving a "confirmation" signal from the third float switch that the working fluid level in the first liquid piston chamber has dropped to a level substantially at the bottom of the first liquid piston chamber.

20. The gas injection system of claim 19, wherein the processor is further configured to:

delay sending the first switching signal to the switch valve by 0.2 to 2.0 seconds after receiving the "fill" signal from the first float valve switch to ensure full displacement of fugitive gas from the first liquid piston chamber; and delay sending the second switching signal to the switch valve by 0.2 to 2.0 seconds after receiving the "fill" signal from the second float valve switch (and the "confirmation" signal from the third float valve switch) to ensure full displacement of fugitive gas from the second liquid piston chamber.

21. The gas injection system of claim 20, wherein:

the delay in sending the first switching signal causes a portion of the incompressible working fluid to be expelled through the first discharge line and into the reservoir;

the delay in sending the second switching signal causes a portion of the incompressible fluid to be expelled through the second discharge line and into the reservoir; and wherein the processor is further configured to tune the period of delay for sending the first switching signal and for sending the second switching signal based upon a ratio of a number of "strokes" within one of the first and the second liquid piston chambers, to the frequency of "Fluid Return Events," and a Fluid Return Event is defined as an event where excess incompressible working fluid is moved from the fluid reservoir back into the pump.

22. The gas injection system of claim 16, wherein:

the gas feed line transports compressible hydrocarbon fluids produced from the wellbore;

the gas feed line feeds the compressible hydrocarbon fluids from the gas compressor to the liquid piston compressor at a pressure of up to 1,000 psi; and the liquid piston compressor delivers gas into the gas outlet line at a pressure of up to 4,000 psi.

* * * * *